US008814230B2

(12) United States Patent
Mullenbach

(10) Patent No.: US 8,814,230 B2
(45) Date of Patent: Aug. 26, 2014

(54) CLIP ON DOORSTOP

(76) Inventor: Alan Mullenbach, Oswego, IL (US)

( * ) Notice: Subject to any disclaimer, the term of this patent is extended or adjusted under 35 U.S.C. 154(b) by 106 days.

(21) Appl. No.: 13/507,472

(22) Filed: Jul. 2, 2012

(65) Prior Publication Data

US 2014/0001775 A1 Jan. 2, 2014

(51) Int. Cl.
*E05C 19/18* (2006.01)

(52) U.S. Cl.
USPC ..... 292/288; 292/DIG. 15

(58) Field of Classification Search
USPC ..... 292/288, DIG. 15
See application file for complete search history.

(56) References Cited

U.S. PATENT DOCUMENTS 1,044,728 A * 11/1912 Basler ..... 292/338
2,097,349 A * 10/1937 Sladek ..... 292/338
7,065,830 B2 * 6/2006 Bushey ..... 16/82

* cited by examiner

*Primary Examiner* — Mark Williams
(74) *Attorney, Agent, or Firm* — McDonnell Boehnen Hulbert & Berghoff LLP

(57) ABSTRACT

Disclosed is a doorstop assembly which allows a doorstop to be conveniently installed or removed from left or right swinging doors of varying thicknesses. The assembly has a portable door clip which may be easily pulled off a left swing door, turned upside down, and then pushed into place onto a right swing door. The portable door clip can firmly embrace doors of varying thickness. A dual lock leg mounted to the front of the door clip can be stowed in an upward position regardless of which way the door clip is turned, and then lowered toward the floor surface when in use to stop the door from closing.

19 Claims, 7 Drawing Sheets

CLIP ON DOORSTOP

FIELD OF THE INVENTION

The present invention relates to doorstops, and more particularly, to a Portable clip on doorstop assembly that mounts onto standard swing type doors.

BACKGROUND OF THE INVENTION

Standard type mounted doorstops are known in the art. They are typically mounted to the surface of a door with various types of mounting hardware. When the door is opened, the doorstop leg is moved from an upward stowed position to a downward position where it engages the floor and holds the door in place as shown in U.S. Pat. No. 3,831,989. Due to their mounting hardware, they tend to be permanently affixed to one door and not portable enough to move to other doors that require a doorstop. If they are removed, they leave behind holes or other damage in the doors they were mounted to.

To address the problem of portability, doorstop assemblies such as shown in U.S. Pat. No. 2,709,615, U.S. Pat. No. 5,542,725, and U.S. Pat. No. 2,774,622 were made. These door stop assemblies are associated with several disadvantages. Clip style assemblies such as U.S. Pat. No. 2,709,615 had the advantage of a simple design, but did not take into account varying door thickness. The design in U.S. Pat. No. 2,774,622 and U.S. Pat. No. 5,542,725 accommodate varying door thickness, however they contain a multitude of moving parts which allow for a higher probability of mechanical failure. An overabundance of moving parts also increases the difficulty of installation and removal of the assembly.

None of these prior art devices disclose the use of a clip on doorstop assembly which accommodates for varying door thickness and allows for easy removal and installation onto left or right swinging doors.

SUMMARY OF THE INVENTION

The present invention is an improved doorstop assembly which allows the doorstop to be mounted onto a left or right swinging door of varying thickness. A doorstop assembly comprises a portable door clip formed from a spring steel or other suitable flexible material. The portable door clip comprises a first front side for abutting a planar side of a door, a second side for abutting the jamb side of a door, and a third back side for abutting the opposite planar side of a door. The first front side is attached to the second side at a right or acute angle and the second side is attached to the third backside at a substantially acute angle. The design of the portable door clip provides a means of affixing the entire portable doorstop assembly to a door of varying thickness by employing a spring tension. A dual lock leg is pivotally mounted on the face of the first front side of the portable door clip such that the pivotal mounting allows the dual lock leg to move from an essentially upward vertical stowed position to an essentially downward floor engaging position. The downward floor engaging position of the dual lock leg is intended to hold the door open. The dual lock leg is provided a support means for a dual lock capability such that it may be locked in an upward vertical stowed position even though the entire doorstop assembly may be rotated upside down prior to installation onto a door.

One object of the invention is to provide a doorstop that is easily secured to a door, and when needed, moved to a different door that may swing in the opposite direction or have a different thickness. The portable door clip is shaped to embrace different door thicknesses and is simply pushed into place onto the side of the door where it is held by spring tension and ready for operation. In order to remove the doorstop assembly from one door and install it onto a door which opens in the opposite direction the doorstop assembly need only to be turned upside down relative to the first door and then pushed into place onto the second door. The dual lock leg may be functionally stowed when rotated in an upward position, regardless of the reorientation of the entire doorstop assembly, by employing multiple support means such as a mechanical, Velcro, or magnets.

A further object of the invention is to provide a portable doorstop that does not damage the surface on which it is mounted. The portable door clip may employ a coating of Teflon, double sided tape, rubber, or other suitable materials which provide a greater protection against chaffing damage between the portable door clip and the door to which it is affixed.

BRIEF DESCRIPTION OF THE DRAWINGS

The accompanying drawings incorporated in the specification illustrate several aspects of the invention, and together with the description serve to explain the principles of the invention.

DETAILED DESCRIPTION

Figure 1:
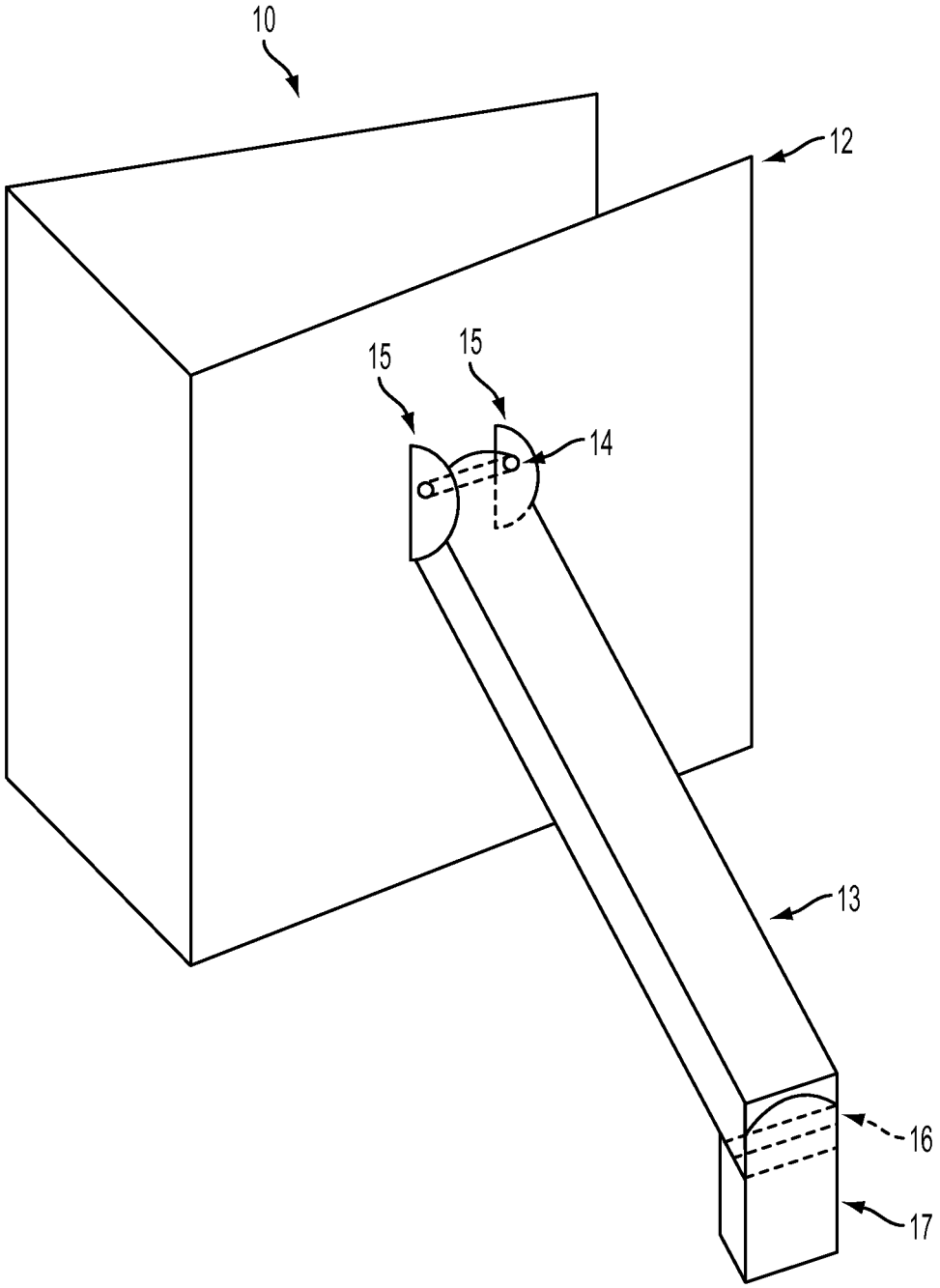
FIG. 1 is a perspective view from the front showing the doorstop assembly in the lowered floor engaging position.
Figure 2A:
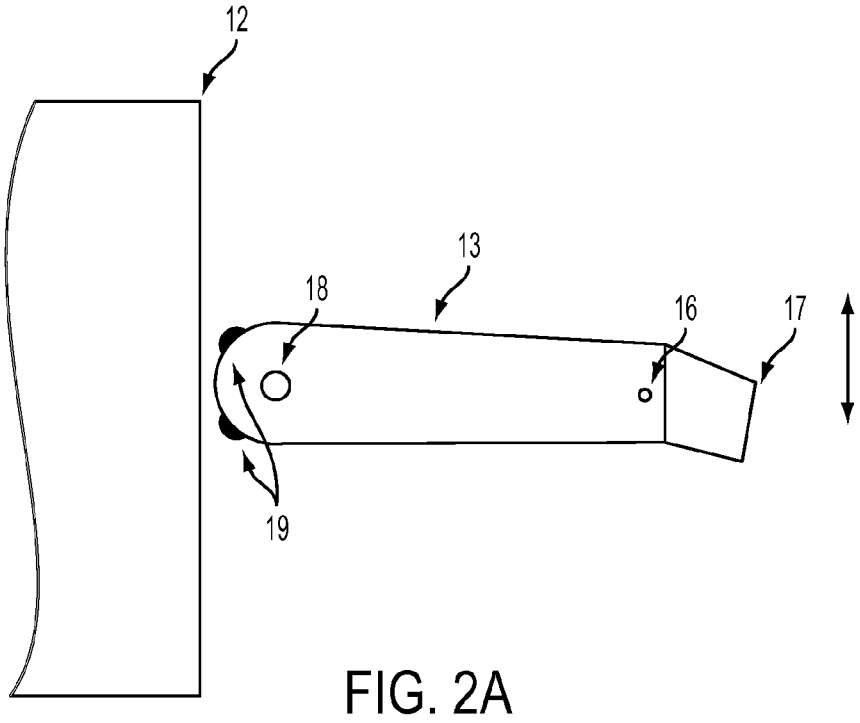
FIG. 2*a* is a side view of the portable door clip with the dual lock leg and its support spurs, positioned between lowered floor engagement and vertical stowed position.
Figure 2B:
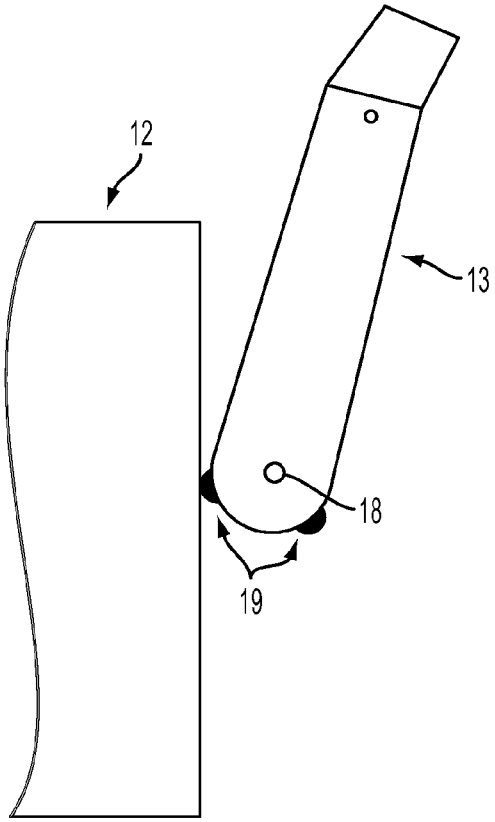
FIG. 2*b* is a side view of the portable door clip, dual lock leg, and support spurs in the vertical stowed position.
Figure 2C:
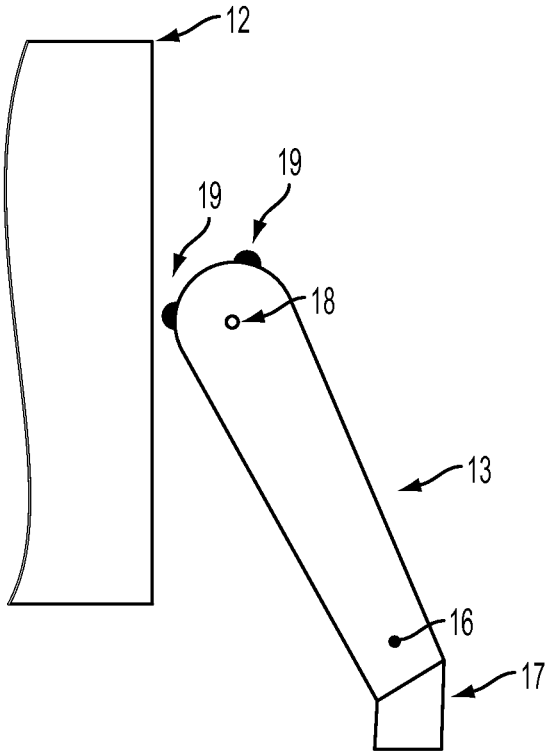
FIG. 2*c* is a side view of the portable door clip, dual lock leg, and its support spurs in the lowered floor engaged position.
Figure 3A:
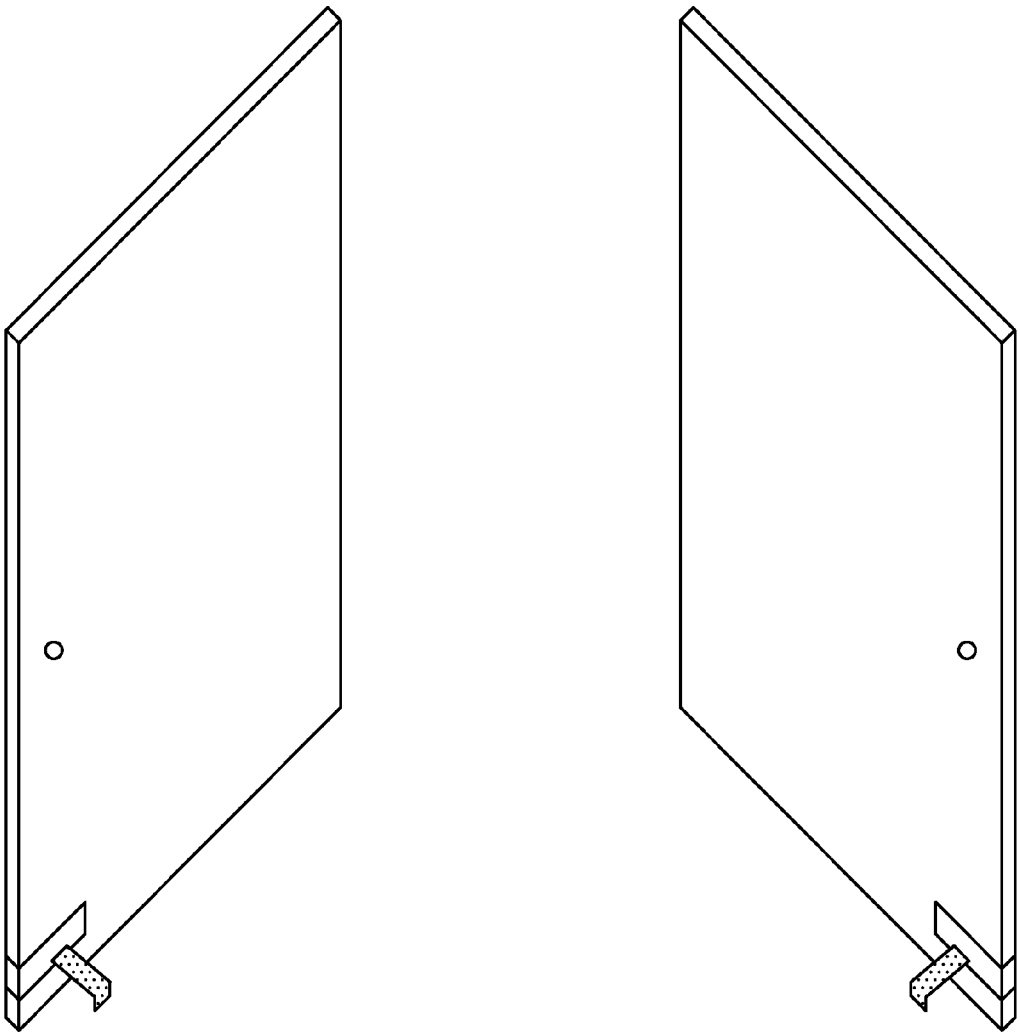
FIG. 3*a* is a perspective view showing the doorstop assembly mounted onto a left and right standard swing type door.
Figure 3B:
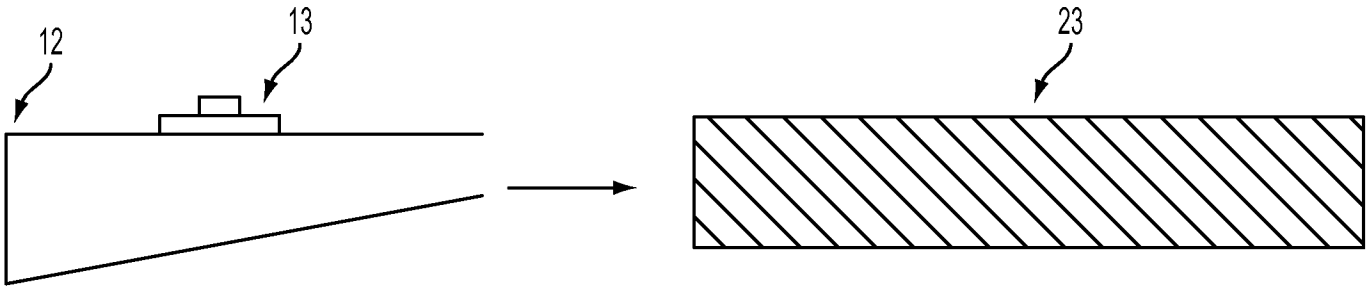
FIG. 3*b* is a top down view of the doorstop assembly prior to mounting onto a standard swing type door.
Figure 3C:
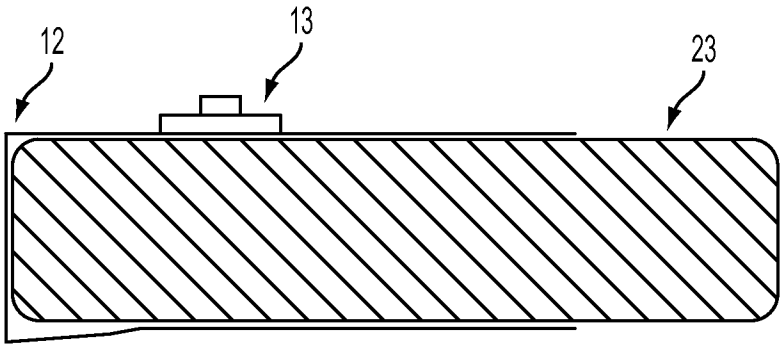
FIG. 3*c* is a top down view of the doorstop assembly after it is installed onto a standard swing type door.
Figure 4:
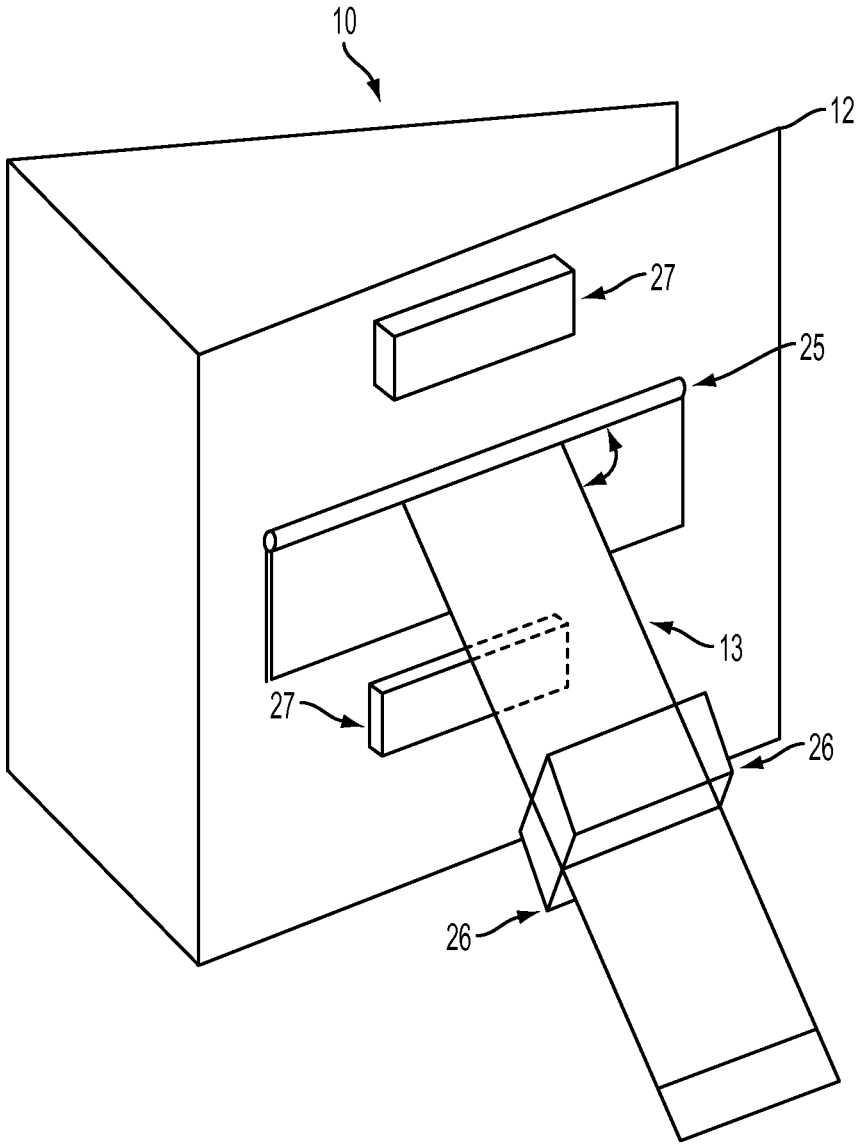
FIG. 4 is a perspective view from the front showing an alternative embodiment wherein the portable door clip and the dual lock leg comprised support magnets.
Figure 5:
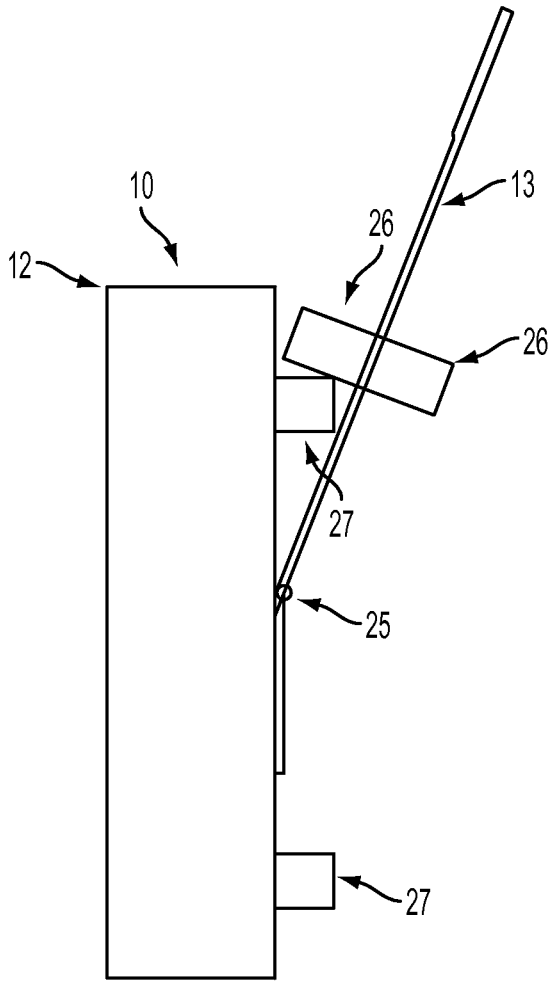
FIG. 5 is a side view showing the support magnets holding the dual lock leg in a vertical stowed position.

Referring to FIGS. 1, 4 and 5 a door stop assembly 10 employs a portable door clip 12. The portable door clip 12 comprises sequence of three sides which may be obtained by folding a single piece of flat planar material such as spring steel or other suitable flexible material. One of ordinary skill in the art will understand there are a number of alternative ways to either fold or attach the three sides such as welding, or various adjoining hardware. As displayed in FIGS. 3*b* and 3*c*, the three sides of the portable door clip 12 comprise a first front side which is intended to abut the planar side of a swing door 23, a second side positioned at a right or acute angle to the first side which is intended to abut the jamb side of the door 23, and a third back side positioned at a substantially acute angle to the second side which is intended to abut the opposite planar side of the door 23 as the first front side. Because of its flexibility, angle pattern, and the surface area of its corresponding sides, the portable door clip 12 is designed to embrace a standard swing type door of varying thickness by simply pushing it into place onto the door 23. Alternatively, additional components such as a sheet of flat rubber, or various coatings such as rubber or adhesive may be affixed to the inside concave portion of the portable door clip 12 to enhance embracing firmness, and to prevent damage to the door 23 mounting surface. Referring to FIG. 3*a* the doorstop assembly 10 is reversible such that it may be removed from a right swing door 21, reoriented upside down in other words, flipped or rotated 180 degrees), and then reinstalled onto a left swing door 22. Pivotally attached to the first front side of the portable door clip 12 is a dual lock leg 13. Referring to FIG. 1, which depicts one embodiment, the dual lock leg 13 is pivotally attached to the face of the portable door clip 12 using pivots 14 capable of rotating around an axis, shaft, hinges or pins. The pivots 14 allow the dual lock leg 13 to be raised toward a vertical stowed position, or to be operationally rotated lower toward a position which enables the dual lock leg 13 to engage with a floor surface thus stopping a door from swinging. When the doorstop assembly 10 is not installed onto a door, the pivots 14 allow the dual lock leg 13 to rotate from a full upward position to a full downward position with both of these positions being essentially parallel to the portable door clip 12. It is essential to the proper operation of the doorstop assembly 10 that the dual lock leg 13 has a means of support to lock in an upward vertical stowed position within both possible operational orientations of the portable door clip 12. Continuing in this embodiment shown in side view FIGS. 2*a*, 2*b*, and 2*c* the dual lock leg 13 comprises a conventional pivot hole 18 and a pair of spurs 19 either attached to or as an integral part of the dual lock leg 13. In contrast with prior art which typically employs the use of only a single spur, the pair of spurs 19 creates a means of support for a dual lock capability. Depending on the appropriate orientation of the portable door clip 12, whichever of these spurs 19 is located in the upward most position will engage with the flat surface face of the portable door clip 12, or alternatively will engage with an additionally added flat surface component when the dual lock leg 13 is rotated into an upward vertical stowed position. The engagement of the upper spur 19 with the flat surface will cause sufficient friction to maintain the dual lock leg 13 in an upward stowed position. The dual lock leg 13 may comprise a thoroughly solid element, or alternatively an additional foot member 17 may be pivotally attached using a shaft, hinge, or pin 16 to accommodate the variable angles of floor engagement. Alternatively, the foot member 17 may comprise a rubberized tip or coating to facilitate greater friction between itself and the floor surface with which it interacts.

In another embodiment shown in FIG. 4 and FIG. 5 the doorstop assembly 10 comprises a portable door clip 12 with a pivotally attached dual lock leg 13, and a plurality of support magnets 26 and 27. This embodiment employs the use of magnets to achieve dual lock capability of the dual lock leg 13. Support magnets 27 are affixed to the face of the portable door clip 12, and additionally, support magnets 26 are affixed to the dual lock leg 13 by employing a variety of mounting hardware, glue, Velcro, or by magnetic attraction alone. Alternatively, support magnets may be affixed to the portable door clip 12, or to the dual lock leg 13 alone. The pivot 25 is attached to the face of the portable door clip 12 and allows the dual lock leg 13 an operational rotation range from an upward stowed position to a downward floor engaging position. The placement of the support magnets 26 and 27 enable the dual lock leg 13 to become locked in the vertical upward stowed position regardless of the orientation of the portable door clip 12 when the doorstop assembly 10 is not in use.

The invention claimed is:

1. A doorstop assembly comprising:

a portable door clip comprising a first side, a second side, and a third side, the portable door clip being configurable to attach the doorstop assembly to a door such that an inner surface of the second side abuts a jamb side of the door, wherein the first side and the second side are positioned such that an angle between the first side and the second side is one of a right angle or an acute angle, and wherein the second side and the third side are positioned such that an angle between the second side and the third side is a substantially acute angle; and a dual lock leg having a proximal end and a distal end, the proximal end of the dual lock leg pivotally mounted on an outer surface of the first side of the portable door clip, wherein the dual lock leg is rotatable from an essentially upward vertical position to an essentially downward vertical position, and wherein the dual lock leg comprises a plurality of dual lock leg supports configured to maintain the dual lock leg in one of the essentially upward vertical position or the essentially downward vertical position, wherein the doorstop assembly is attachable to the door regardless of whether the door is left-opening or right-opening.

2. The doorstop assembly of claim 1, wherein the portable door clip is flexible and has sufficient spring tension to accommodate a thickness of the door.

3. The doorstop assembly of claim 2, wherein an inner surface of the first side of portable door clip, the inner surface of the second side of the portable door clip, and an inner surface of the third side of the portable door clip form a concave portion of the portable door clip, wherein at least one surface of the concave portion comprises at least one additional component configured for one of enhancing a firmness of the portable door clip when attached to the door or preventing damage to the door.

4. The doorstop assembly of claim 3, wherein the at least one additional component comprises a flat sheet of rubber.

5. The doorstop assembly of claim 2, wherein an inner surface of the first side of portable door clip, the inner surface of the second side of the portable door clip, and an inner surface of the third side of the portable door clip form a concave portion of the portable door clip, wherein at least one surface of the concave portion comprises a coating configured for one of enhancing a firmness of the portable door clip when attached to the door or preventing damage to the door.

6. The doorstop assembly of claim 1, wherein the plurality of dual lock leg supports comprises a plurality of support spurs at the proximal end of the dual lock leg, wherein each support spur is configured to engage a flat surface of the portable door clip in order to maintain the dual lock leg in one of the essentially upward vertical position or the essentially downward vertical position.

7. The doorstop assembly of claim 6, wherein the plurality of supports spurs are affixed to the proximal end of the dual lock leg.

8. The doorstop assembly of claim 6, wherein the plurality of supports spurs are integral to the proximal end of the dual lock leg.

9. The doorstop assembly of claim 1, wherein the dual lock leg comprises a foot member at the distal end of the dual lock leg, wherein the foot member is rotatable to engage a floor surface.

10. The doorstop assembly of claim 1, wherein the plurality of dual lock leg supports comprises a plurality of magnets.

11. A doorstop assembly comprising:

a portable door clip configurable to attach the doorstop assembly to a jamb side of left-opening doors and right-opening doors, the portable door clip comprising (i) a first side, (ii) a second side adjacent to the first side, (iii) a third side adjacent to the second side, wherein the first side and the second side form one of a right angle or an acute angle, and wherein the second side and the third side form a substantially acute angle; and a dual lock leg pivotally mounted on an outer surface of the first side of the portable door clip, wherein the dual lock leg is rotatable from a first vertical position to a second vertical position, wherein the portable door clip further comprises a plurality of components configured to maintain the dual lock leg in one of (a) the first vertical position when the dual lock leg is rotated to the first vertical position or (b) the second vertical position when the dual lock leg is rotated to the second vertical position, for left-opening doors, the first vertical position is substantially upward and the second vertical position is substantially downward, and for right-opening doors, the second vertical position is substantially upward and the first vertical position is substantially downward.

12. The doorstop assembly of claim 11, wherein the dual lock leg further comprises a plurality of magnets configured to maintain the dual lock leg in one of the first vertical position or the second vertical position.

13. The doorstop assembly of claim 11, wherein an inner surface of the first side, an inner surface of the second side, and an inner surface of the third side form a concave portion of the portable door clip, wherein at least one surface of the concave portion comprises a coating configured for one of enhancing a firmness of the portable door clip when attached to the door or preventing damage to the door.

14. The doorstop assembly of claim 11, wherein the portable door clip is flexible and has sufficient spring tension to accommodate different thicknesses of the left-opening doors and the right-opening doors.

15. The doorstop assembly of claim 11, wherein the plurality of components comprises a plurality of magnets located on the outer surface of the first side of the portable door clip.

16. The doorstop assembly of claim 11, wherein the dual lock leg further comprises a plurality of additional components configured to maintain the dual lock leg in either the first vertical position or the second vertical position.

17. The doorstop assembly of claim 11, wherein:

the dual lock leg comprises a proximal end and a distal end, the proximal end of the dual lock leg is pivotally mounted on the portable door clip, and the duel lock leg comprise a foot member at the distal end of the dual lock leg, wherein the foot member is rotatable to engage a floor surface.

18. The doorstop assembly of claim 11, wherein an inner surface of the first side, an inner surface of the second side, and an inner surface of the third side form a concave portion of the portable door clip, wherein at least one surface of the concave portion comprises at least one additional component configured for one of enhancing a firmness of the portable door clip when attached to the door or preventing damage to the door.

19. The doorstop assembly of claim 18, wherein the at least one additional component comprises a flat sheet of rubber.

* * * * *